US010240307B2

(12) United States Patent
Punzengruber

(10) Patent No.: US 10,240,307 B2
(45) Date of Patent: Mar. 26, 2019

(54) BELT STANCHION FOR A PEOPLE GUIDANCE SYSTEM

(71) Applicant: Qmetrix GmbH, Vienna (AT)

(72) Inventor: Dieter Punzengruber, Vienna (AT)

(73) Assignee: QMETRIX GMBH, Vienna (AT)

( * ) Notice: Subject to any disclaimer, the term of this patent is extended or adjusted under 35 U.S.C. 154(b) by 420 days.

(21) Appl. No.: 15/300,320

(22) PCT Filed: Jan. 28, 2015

(86) PCT No.: PCT/AT2015/050028
§ 371 (c)(1),
(2) Date: Sep. 29, 2016

(87) PCT Pub. No.: WO2015/161328
PCT Pub. Date: Oct. 29, 2015

(65) Prior Publication Data

US 2017/0167093 A1 Jun. 15, 2017

(30) Foreign Application Priority Data

Apr. 23, 2014 (EP) ..... 14165704

(51) Int. Cl.
*E01F 13/02* (2006.01)
*G08B 13/06* (2006.01)
(Continued)

(52) U.S. Cl.
CPC ..... *E01F 13/028* (2013.01); *E01F 13/022* (2013.01); *G08B 13/06* (2013.01);
(Continued)

(58) Field of Classification Search
CPC ..... E01F 13/02; E01F 13/022; E01F 13/028; G08B 13/06; G08B 19/005; G08B 25/009; G08B 25/12
See application file for complete search history.

(56) References Cited

U.S. PATENT DOCUMENTS 5,245,787 A * 9/1993 Swenson ..... E01F 13/028 404/9
5,452,542 A * 9/1995 Bardwell ..... E01F 13/028 49/322
(Continued)

FOREIGN PATENT DOCUMENTS

CN 201095729 8/2008
CN 101525867 9/2009
(Continued)

OTHER PUBLICATIONS

International Preliminary Report on Patentability dated Nov. 3, 2016 for PCT/AT2015/050028.
(Continued)

*Primary Examiner* — Matthieu F Setliff
(74) *Attorney, Agent, or Firm* — Hoffman & Baron, LLP

(57) ABSTRACT

The present invention relates to a belt stanchion for a people guidance system, comprising a belt that can be extended from the belt stanchion, counter to the force of a retracting device. The belt stanchion further comprises a closure having two mutually complementary coupling members, of which the first coupling member is disposed at the free end of the belt and the second coupling member is disposed on the belt stanchion. At least one of the coupling members is configured with an opener for the closure. The opener comprises a receiver for detecting a remote control signal, an actuator activated by the receiver upon such detection for opening the closure, and at least one energy store supplying the receiver and the actuator.

18 Claims, 7 Drawing Sheets

(51) Int. Cl.
*G08B 19/00* (2006.01)
*G08B 25/00* (2006.01)
*G08B 25/12* (2006.01)

(52) U.S. Cl.
CPC ..... *G08B 19/005* (2013.01); *G08B 25/009* (2013.01); *G08B 25/12* (2013.01)

(56) References Cited

U.S. PATENT DOCUMENTS 5,537,778 A * 7/1996 Bardwell ..... E01F 13/028 49/322
5,871,038 A * 2/1999 Gompertz ..... E01F 13/028 160/328
6,135,190 A * 10/2000 Gompertz ..... E01F 13/028 160/328
6,192,627 B1 * 2/2001 Gompertz ..... E01F 13/028 160/330
6,349,503 B1 * 2/2002 Gompertz ..... E01F 13/028 49/34
6,375,164 B1 * 4/2002 Siegler ..... E01F 13/028 256/1
6,485,225 B1 * 11/2002 Baker ..... E01F 13/028 160/331
6,830,236 B2 * 12/2004 Augusto de Lorenzo ..... E01F 13/028 256/1
6,845,589 B1 * 1/2005 Thompson ..... E05B 65/0007 49/34
7,178,790 B2 * 2/2007 de Lorenzo ..... E01F 13/028 160/24
7,207,370 B2 * 4/2007 Snyder ..... E01F 13/028 160/23.1
7,237,591 B2 * 7/2007 Snyder ..... E01F 13/028 160/23.1
7,337,822 B2 * 3/2008 Snyder ..... E01F 13/028 160/23.1
7,380,375 B2 * 6/2008 Maly ..... B65G 69/2882 340/524
7,768,428 B1 8/2010 Leisure
8,087,443 B2 * 1/2012 Snyder ..... E01F 13/028 160/23.1
8,490,668 B2 * 7/2013 Snyder ..... E01F 13/028 160/23.1
8,547,234 B2 * 10/2013 Maly ..... B65G 69/2882 14/6
8,590,087 B2 * 11/2013 Swessel ..... B65G 69/2882 14/69.5
10,094,081 B1 * 10/2018 Gill ..... E01F 13/042
2009/0096572 A1 * 4/2009 Bosik ..... E01F 13/028 340/5.7
2015/0137057 A1 * 5/2015 Weiner ..... E01F 13/028 256/40
2016/0047953 A1 * 2/2016 Crawley ..... G02B 5/136 256/65.02
2016/0244923 A1 * 8/2016 Green ..... E01F 13/028
2017/0038004 A1 * 2/2017 Kalinski ..... F16P 1/02
2018/0170709 A1 * 6/2018 Chen ..... E01F 13/028
2019/0011081 A1 * 1/2019 Kalinski ..... E01F 13/02

FOREIGN PATENT DOCUMENTS

DE 102006017682 10/2007
DE 102007021484 11/2008
EP 0287510 A1 * 10/1988 ..... E01F 13/028
EP 0352071 A1 * 1/1990 ..... A01K 3/00
EP 2942435 B1 * 9/2016 ..... E01F 13/028
GB 2247095 A * 2/1992 ..... E01F 13/028
JP 202363933 12/2002
WO WO-9707005 * 2/1997 ..... E01F 13/028
WO WO 2006064267 6/2006

OTHER PUBLICATIONS

European Search Report for Application No. 14165704.9-1604 dated Oct. 16, 2014.
International Search Report for PCT/AT2015/050028 dated Apr. 14, 2015.
ISA Written Opinion for PCT/AT2015/050028 dated Jan. 28, 2015.
Office Action in corresponding Chinese application.

* cited by examiner

BELT STANCHION FOR A PEOPLE GUIDANCE SYSTEM

CROSS-REFERENCE TO RELATED APPLICATIONS

This application is a National Phase application of International Application No. PCT/AT2015/050028 filed Jan. 28, 2015 which claims priority to European Patent Application No. 14 165 704.9 filed Apr. 23, 2014, the disclosures of which are incorporated herein by reference.

BACKGROUND

The present application relates to a belt stanchion for a people guidance system which comprises a belt that can be extended from the belt stanchion, counter to the force of a retracting device, and a closure having two mutually complementary coupling members, of which the first is disposed at the free end of the belt and the second is disposed on the belt stanchion.

Such belt stanchions are frequently used in common areas at airports or in the cash register area of department stores to guide people on predefined paths, temporarily close off inaccessible areas, or control the formation of waiting lines. The belt stanchions are generally mobile and have a widened base for a secure footing. The first coupling member at the free end of the belt, which at times is also designed as a rope or the like, is manually anchored at the second coupling member of a neighboring, identical belt stanchion, which is to say the closure is closed, and thereby a manually reopenable barrier is created between the two belt stanchions. The belt stanchions generally comprise two or more, typically three, second coupling members that are distributed over the circumference thereof and, in this way, allow for a flexible configuration of passageways and waiting lines using neighboring belt stanchions in different directions.

Such belt stanchions for people guidance systems are flexible and easy to use. However, if such a common area, which is subdivided by such belt stanchions, is to be cleared quickly, such as an airport terminal in the event of a fire, the belt stanchions connected to each other in multiple instances pose significant obstacles because the belts and belt stanchions act like a net for the quickly moving crowd of people. Individual persons may literally become entangled in the belts or fall, which in the case of rapid clearing of the common area can have fatal effects, in particular when panic arises.

A people guidance system is known from GB 2 102 4166, in which ropes having a fixed length are tensioned between mobile posts by anchoring each end of a rope at a respective head of one post; the anchoring has a predetermined breaking point on the rope in the form of spring-loaded locking pin engaging in boreholes on the post, so that they are released when a strong tensile force is applied. In this way, the rope can be opened by anyone by firm pulling. However, such a predetermined breaking point is not visible, and the rope represents an obvious obstacle until opening. Moreover, an actual release cannot be ensured in the event of panic, in particular when an uncontrolled, oblique tensile action is applied, and every rope that is released on one side remains an obstacle on the floor. Moreover, such a people guidance system can also be easily rendered ineffective by anyone even in the absence of an emergency situation by applying a tensile force and opening the predetermined breaking point.

SUMMARY

It is an object to create a belt stanchion for a people guidance system which, during normal operation, ensures familiar, safe handling, but can be passed in an emergency without posing an obstacle.

This object is achieved by a belt stanchion for a people guidance system, comprising a belt that can be extended from the belt stanchion, counter to a force of a retracting device, and a closure having two mutually complementary coupling members, of which the first coupling member is disposed at a free end of the belt and the second coupling member is disposed on the belt stanchion, wherein at least one of the coupling members is configured with an opener for the closure, the opener comprising a receiver for detecting a remote control signal, an actuator activated by the receiver upon such detection for opening the closure, and at least one energy store supplying the receiver and the actuator.

In this way it is possible for the first time to render common areas and aisles freely passable in every direction in response to a remote control signal. As a result of the force of the retracting device, the belts are completely retracted into the belt stanchions and no longer pose any obstacle whatsoever. The retracting devices can be decelerated so that whip-like overshooting due to excessively fast retraction of the belts is avoided. It is possible to simultaneously open all closures, or also to selectively open certain closures as a function of predefined remote control signals that differ from each other. When an emergency is automatically detected and the remote control signal is automatically triggered, the opening of the closures can take place entirely without the need for personnel.

It is particularly favorable when the coupling members include complementarily mutually engaging T and C pieces, wherein at least one limb of a T or C piece is movably mounted on the coupling member thereof and can be blocked by the actuator and released upon activation of the actuator. The belt stanchion can thus be operated in the customary manner by inserting the first coupling member into, or pulling it out of, the second coupling member—approximately normal to the force of the retracting device—so as to actuate the closure. Moreover, the movable limbs are accessible from the outside and can thus be easily checked for their functional capability in an emergency or be serviced.

According to an alternative advantageous variant, one coupling member comprises a hook element, which can be engaged on a detent element of the other coupling member, wherein one of the parts that are the hook element and detent element can be disengaged by the actuator. This results in a safe, reliable closure, which nonetheless can be opened with only small resistance and with comparatively small friction surfaces or edges. Such a closure is particularly easy to operate and can be opened by the actuator when the hook element and the detent element can be rotated or displaced with respect to each other.

In a further advantageous embodiment, the coupling members form a magnetic closure having two contact surfaces that magnetically adhere to each other, wherein the actuator, upon activation, spaces the contact surfaces from each other, and optionally tilts them away from each other. Coupling members designed in this way are particularly easy to close since they automatically strive to assume the correct position and thereby provide for an exact fit of the two coupling members. At the same time, even a small distance between the two contact surfaces suffices to overcome the remaining magnetic force by using the force of the retracting device and completely open the closure.

For example a movable frame is suitable for spacing or tilting, the frame being seated on a coupling member outside the contact surface of this coupling member and spacing the contact surface from that of the other coupling member upon activation by the actuator. However, it is particularly easy when the actuator comprises a pin that can be extended out of a contact surface. The pin can optionally be recessed into the contact surface counter to the force of a preloading spring and latchingly engages with an electrically actuatable trigger in the loaded position. In this way, the actual energy for spacing or tilting the two contact surfaces away from each other is supplied to the preloading spring and stored every time the coupling members are closed, which is to say at least a significant portion of the energy store for triggering is manually charged every time the belt is closed; a second electric energy store, which supplies only the receiver and the trigger, can thus be designed considerably smaller and in a weight-saving manner, or achieves a considerably longer service life.

As an alternative, the pin can be electrically extended. Such a pin can be designed as an electromagnetic threaded spindle, for example, which results in a very high extending force due to the action of the thread; on the other hand, particularly fast triggering can be achieved when the pin is designed as the rotor of a linear motor, for example. The respective extending force of the pin can be controlled by regulating the current.

In a further alternative embodiment, the coupling members include magnetic or magnetizable elements, which together form a magnetic closure, wherein one element is movably mounted in the coupling member thereof and can be moved by the actuator upon activation. One element can thus basically be "spaced" on the inside of the coupling member, for example be moved away at an approximately right angle with respect to the magnetic force, which allows a closed, maintenance-free and tamper-proof design of the coupling member, together with the actuator.

In a particularly simple alternative design of the closure which dispenses entirely with mechanical parts that are prone to wear, the closure is a magnetic closure having at least one permanent magnet, and the actuator is a solenoid, which generates a magnetic field that weakens the magnetic field of the permanent magnet upon activation. A brief electric surge in the solenoid suffices to space the two coupling members of the magnetic closure far enough from each other for the force of the retracting device to completely open the closure. Such a magnetic closure can also be actuated any arbitrary number of times without wear and maintenance and is not subject to any loss of function due to dirt accumulation.

The aforementioned retracting device can be a counter weight, or a rubber or spring-loaded strap that is accommodated in the belt stanchion, for example; however, it is particularly simple and space-saving, and therefore preferred, if the retracting device is a spring-loaded belt retractor in the head of the belt stanchion.

According to a further advantageous variant, the opener is disposed in the first coupling member. This allows simple retrofitting of existing belt stanchions since only the first coupling member, which is easily accessible at the belt end, must be replaced. It is even possible to create a first coupling member that opens by remote control and can be placed onto a conventional first coupling member located at the belt end side, and that has the shape of a C piece, for example, which surrounds the existing T piece of the conventional first coupling member, comprising an additional remote-controllable T piece for insertion into a conventional C-shaped second coupling member disposed directly on the belt stanchion. Moreover, the belt stanchions advantageously in each case typically comprise a single belt, and thus only one first coupling member that is disposed at the belt end, however two, or generally three, second coupling members on the belt stanchion side, so that arranging the opener in the first "belt end" coupling member merely requires a single remote-controllable "stanchion" coupling member per belt stanchion, instead of three.

As an alternative, the opener is disposed in the second coupling member on the stanchion side. In this way, the receiver, the actuator and the energy store can be accommodated in the existing space of the belt stanchion, and thus with only minor structural constraints, wherein the first coupling member at the belt end can be designed to be space-saving and small at the same time. Moreover, in this case, with a suitable design of the belt stanchion, it is also possible when multiple second coupling members on the stanchion side are present per belt stanchion that either each coupling member has a separate—optionally retrofittable—opener, or that two or more of these coupling members have a shared opener and share at least the energy store and/or the receiver in the belt stanchion. Depending on the receiver and the actuators, all second coupling members of the belt stanchion can be activated collectively, or individual ones of the coupling members can be separately activated in a targeted manner.

The receiver could be a photoreceiver, for example an infrared receiver, or respond to acoustic remote control signals, such as sounds emitted by loudspeakers or whistles—including those in the ultrasonic range. The receiver, however, is optionally a radio receiver. Such a radio receiver can be designed to be particularly space-saving and energy-saving, has been tried and tested, and is not affected by disturbing signals as compared to acoustic receivers or photoreceivers; moreover, the radio receiver can be provided in a simple manner with a return transmission signal for status queries.

It is particularly favorable if the energy store is a disposable battery. Such a battery has low self-discharge and is easy to check and replace. If the energy of the opener is exerted at least partially mechanically, a second energy store may be provided, for example in the form of a spring, an actuating weight, a gas pressure accumulator or a gas generator.

BRIEF DESCRIPTION OF THE DRAWINGS

The embodiments will be described hereafter in greater detail based on the accompanying drawings. In the drawings.

DETAILED DESCRIPTION

Figure 1:
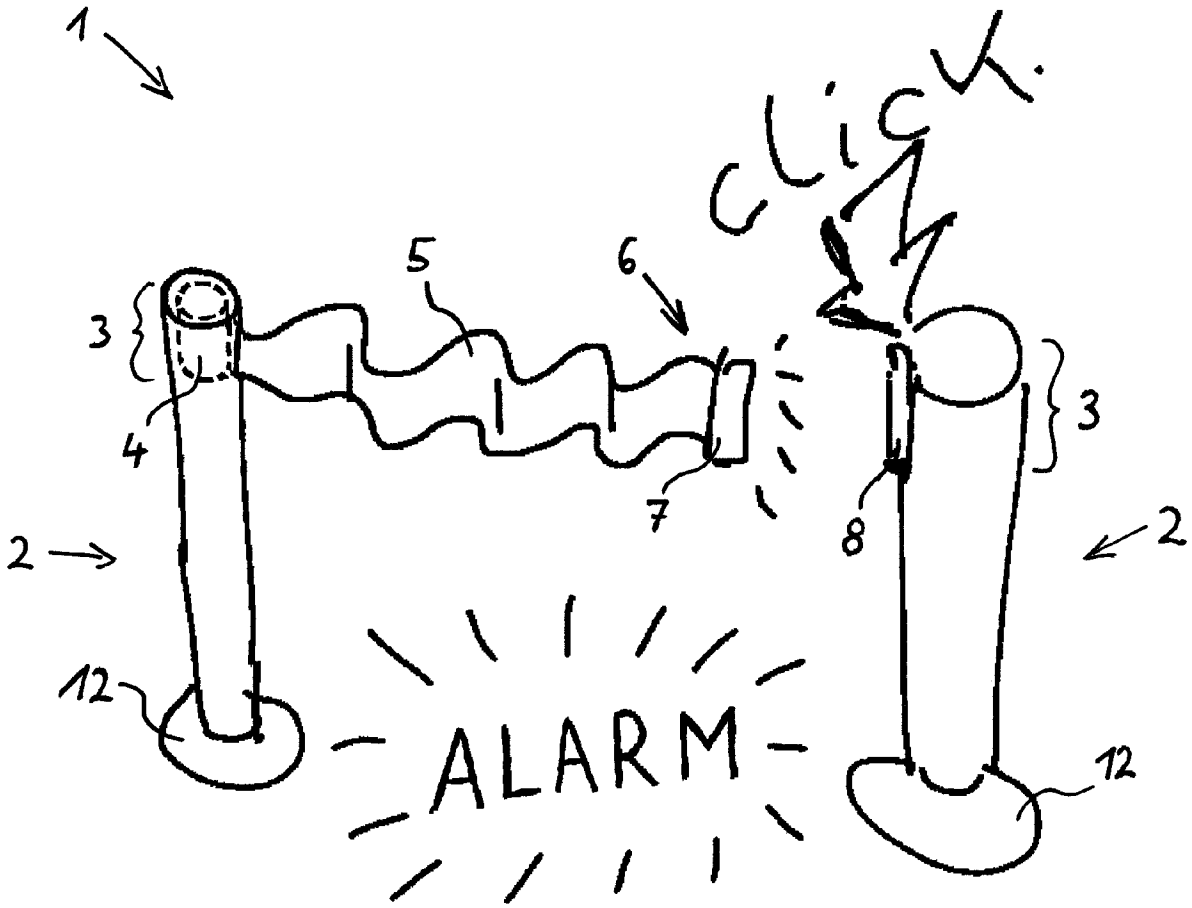
FIG. 1 shows a schematic perspective view of a belt stanchion during remote-controlled opening.
Figure 2:
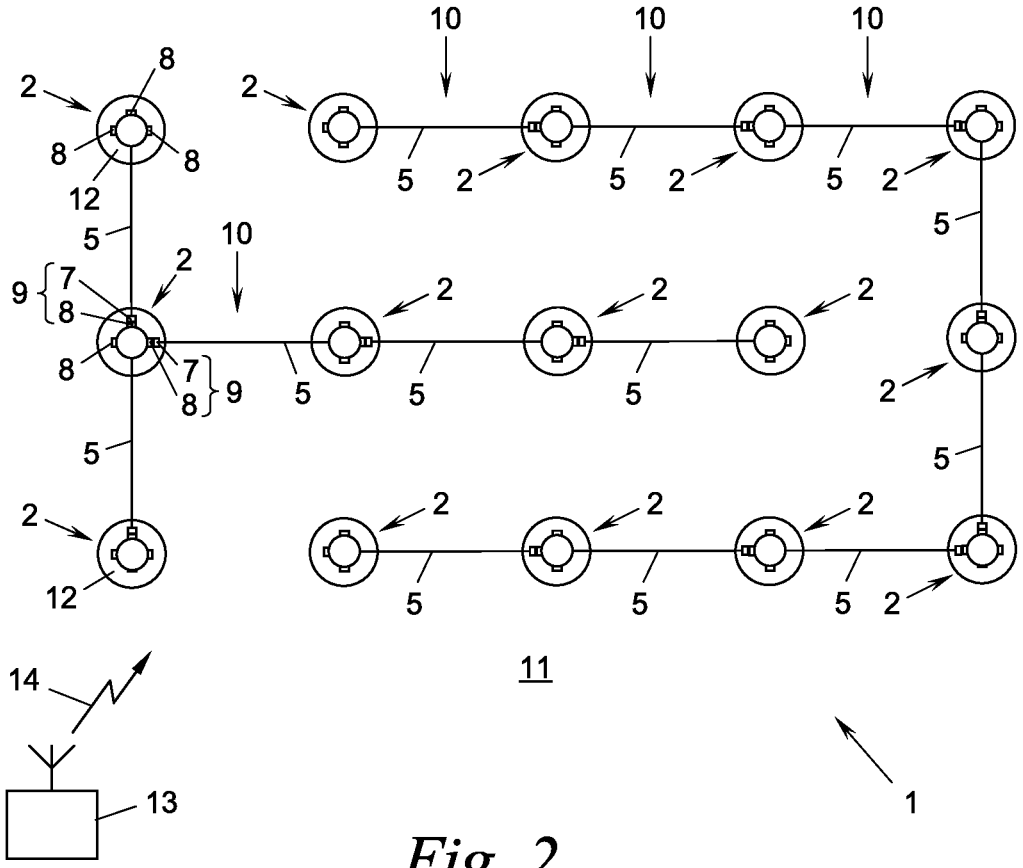
FIG. 2 shows a top view onto multiple belt stanchions of FIG. 1 cooperating as a people guidance system.

According to FIGS. 1 and 2, a people guidance system 1 is formed using multiple belt stanchions 2, which in each case include a belt 5 that can be extended from the head 3 counter to the force of a retracting device 4. At the free end 6, the belt 5 carries a "first" coupling member 7, which forms a closure 9 together with a "second" coupling member 8, which is complementary to the first and is disposed on the belt stanchion 2 or the head thereof 3.

If the first coupling member 7 of a belt stanchion 2 and the second coupling member 8 of a neighboring belt stanchion 2, which is to say the closure 9, are closed, the belt 5 tensioned between the two belt stanchions 2 by the retracting device 4 represents a barrier 10 of the people guidance system 1. In this way, the people guidance system 1 can be used to define walkways or waiting lines in common areas 11 by suitably combining multiple belt stanchions 2, or parts thereof can be closed off for people, even only temporarily.

In the example of FIGS. 1 and 2, the retracting device 4 of the belt 5 is designed as a spring-loaded belt retractor in the head 3 of the belt stanchion 2, and the belt stanchion 2 has an approximately round cross-section. Distributed approximately 90 degrees in each case around the circumference of the head 3, each belt stanchion 2—in addition to the belt 5 including the coupling member 7 shown in FIG. 1—carries one of three further second coupling members 8, see FIG. 2. Of course it is also possible to dispose second coupling members 8 in a different number and a different angular distribution, and/or two or more belts 5 including the first coupling members 7 and respective further second coupling members 8 may be disposed at different heights of each belt stanchion 2.

The belt stanchions 2 are mobile and have a widened base 12; however, as an alternative, they can also be anchored in a permanent foundation—optionally removably—wherein the belt stanchions 2 could even be formed by a mobile or fixed wall element, which carries the retracting device 4 including the belt 5 and the first coupling member 7 or the second coupling member 8. Moreover, the belt 5 could be designed as a rope or the like, and the retracting device could be designed in the form of a counterweight or a rubber or spring-loaded strap, for example on the inside of the belt stanchion 2, and optionally be directed over multiple rollers so as to increase the possible extending path, or act as a tackle assembly, if desired also in a decelerated manner, on the belt 5.

According to FIG. 2, a signal transmitter 12 is disposed within the remote control range of the common area 11, which emits a remote control signal 14, for example in an emergency, so as to open the closures 9 of the belt stanchions 2 in a remotely controlled manner. Each belt 5 is subsequently retracted into the respective belt stanchion 2 as a result of the force of the retracting device 4, and the barriers 10 are removed. For this purpose, at least one of the coupling members 7, 8 of each belt stanchion 2 comprises an opener 15, which will now be described in more detail with reference to FIG. 3.

Figure 3:
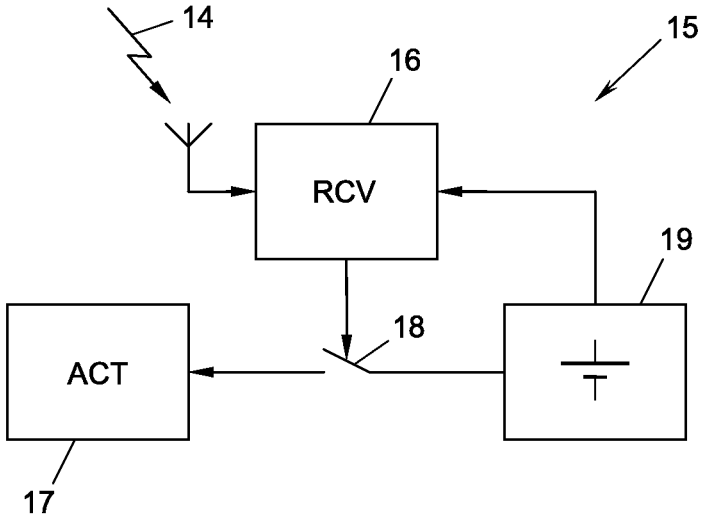
FIG. 3 shows a block diagram of an opener of the belt stanchion of FIG. 1.

According to FIG. 3, the opener 15 comprises a receiver 16, which upon detection of the remote control signal 14 activates an actuator 17; this is symbolized in FIG. 3 by a contact 18, which upon activation by the receiver 16 supplies the energy of an energy store 19 to the actuator 17, whereupon the actuator 17 opens the closure 9. In this example, the receiver 16 is likewise supplied by the energy store 19; however, it would also be possible to use multiple, even differently designed, energy stores 19 to supply the receiver 16 and the actuator 17.

Exemplary embodiments having different actuators 17, coupling members 7, 8 and/or energy stores 19 will be described hereafter based on FIGS. 4 to 10.

Figure 4:
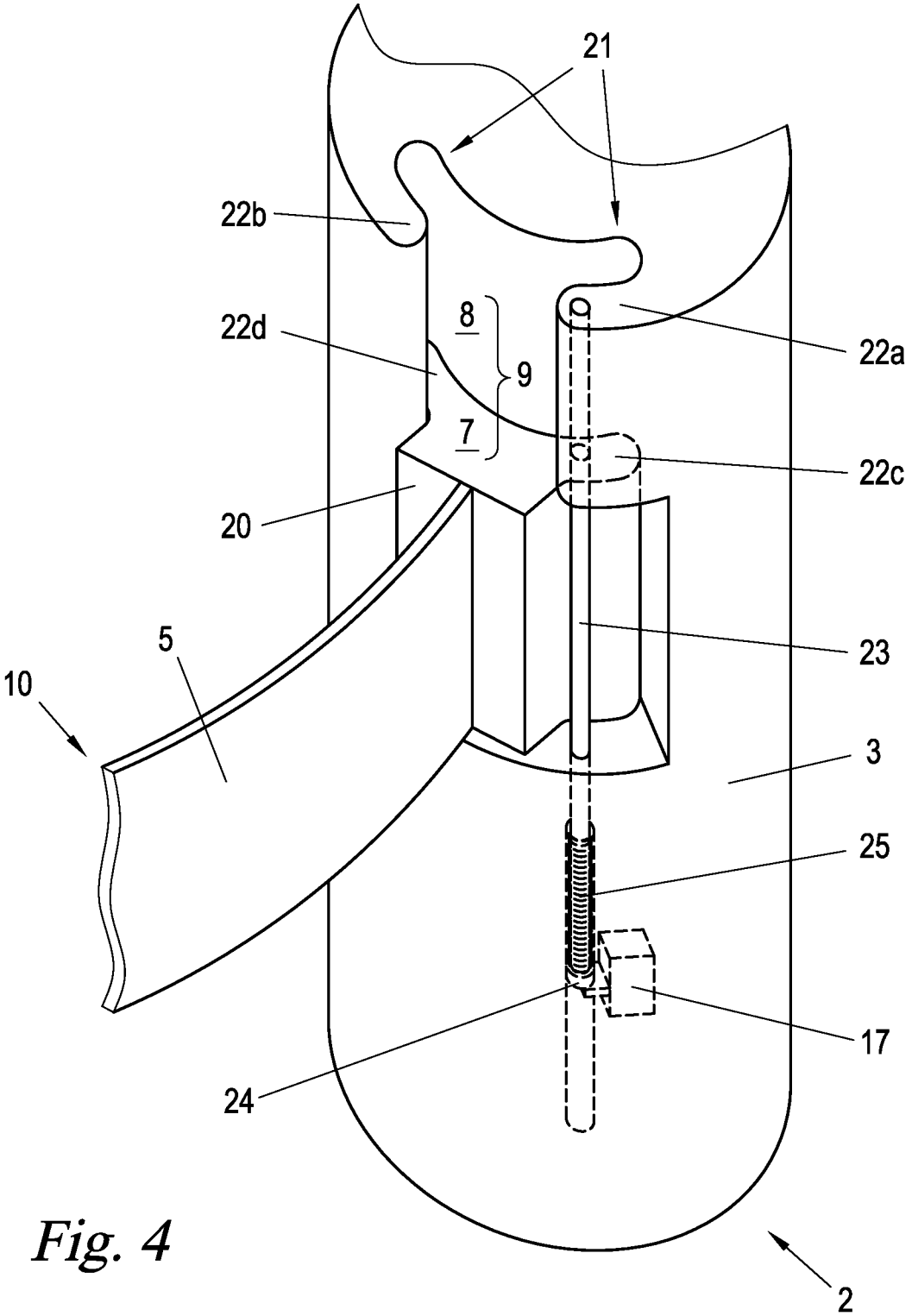
FIGS. 4 and 5 show variants of coupling members of the belt stanchion of FIG. 1 comprising complementarily mutually engaging T and C pieces in a perspective view obliquely from above (FIG. 4) and in a sectional view (FIGS. 5*a* to 5*c*)

In the exemplary embodiment according to FIG. 4, the first coupling member 7 on the belt end side is designed as a T piece, on the center web 20 of which the belt 5 is attached. The first coupling piece 7 is inserted into the second coupling member 8, which is designed as a complementary C piece on the belt stanchion 2 or the head 3, in the known manner, such as from above, whereby the closure 9 is closed and thus the barrier 10 is established. The C-shaped second coupling member 8 can be mounted on the belt stanchion 2; however, as is shown in FIG. 4, it can also be designed as a groove 21 that is doubly undercut in a dovetail-shaped manner in the head 3 of the belt stanchion 2 itself.

So as to open the closure 9 thus formed, a limb 22*a* of the C piece of the second coupling member 8 is mounted movably, for example. In the example of FIG. 4, the movable limb 22*a* is a pin 23, which can be displaced in the longitudinal extension thereof—which here is downward—in the second coupling member 8. The pin 23 has a step 24, on which a preloading spring 25 supported in the second coupling member 8 engages. When the pin 23 is in the closed position thereof shown in FIG. 4, it is blocked by the actuator 17 on the step 24 and the spring 25 is preloaded. When upon activation by the receiver 16 the actuator 17 releases the step 24, and thus the pin 23, the preloading spring 25 pushes the pin 23 so far out of the blocked position thereof that the limb 22*c* of the first coupling member 7 is released, and the same is pulled by the belt 5 out of the second coupling member 8 as a result of the force of the retracting device 4. The previously established barrier 10 is opened up completely as a result of the steps of retracting the belt 5 and rolling up the same in the head 3 of the belt stanchion 2.

It goes without saying that one or more additional ones of the limbs 22*a* to 22*d* can be movable. Moreover, the C piece can also be formed on the first coupling member 7, and the T piece can be formed on the second coupling member 8.

In general, solenoid switches, for example, are used as actuators 17, or also hydraulic or pneumatic elements are possible if suitable power supply is present, which themselves can be switched electrically or electromagnetically, for example.

Figure 5A:
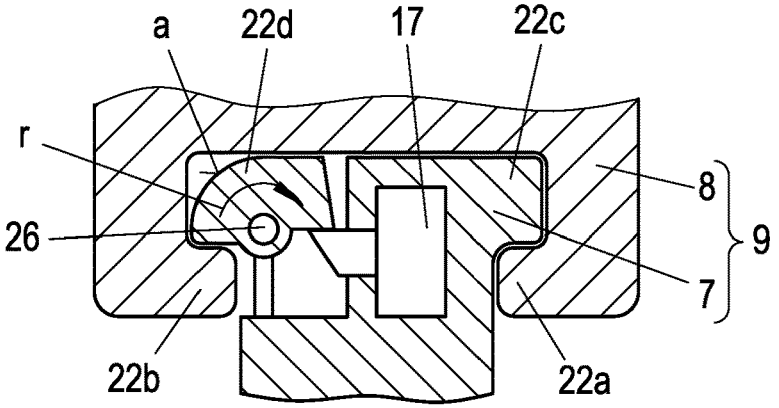
Figure 5B:
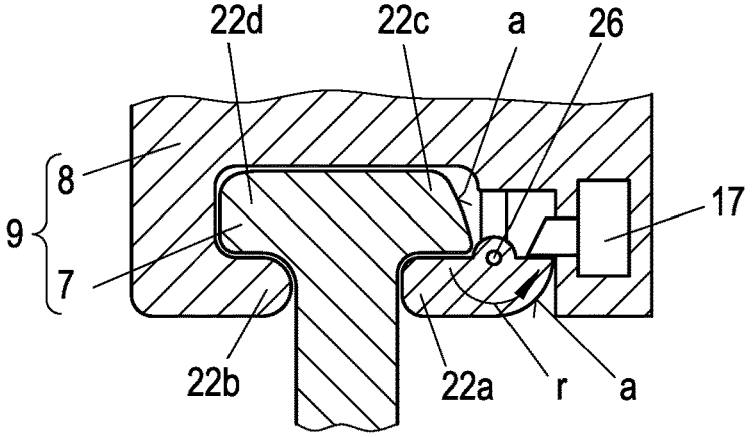
Figure 5C:
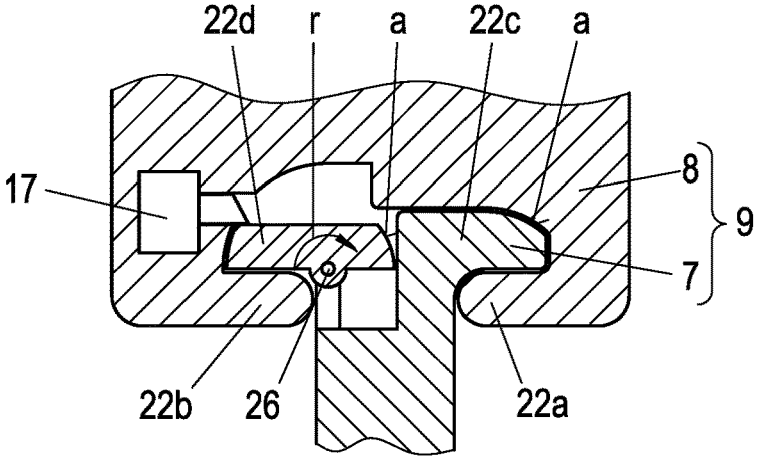

As an alternative to the example of FIG. 4, according to the exemplary embodiments shown in FIGS. 5*a* to 5*c*, a movable limb 22*a* to 22*d* can also be rotatably mounted on a revolute joint 26 on the head 3 or the belt 5 and be blocked by the actuator 17 in the illustrated holding position. In the example of FIG. 5*a*, the limb 22*d* pivots along a pivot path r out of the holding position, in which it latches over the complementary limb 22*b*, upon release by the actuator 17, and opens the closure 9, whereby the first coupling member 7 is again pulled out of the second coupling member 8 as a result of the force of the retracting device 4. As is shown in FIGS. 5*a* to 5*b*, the movable limb 22*d* or 22*a* can be seated together with the actuator 17 both on the C piece and on the T piece. According to FIG. 5*c*, however, the movable limb 22*d* can also be formed on the T piece, and the actuator 17 can be formed on the complementary C piece (or vice versa). Moreover, it is also possible to movably mount two or more of the limbs 22*a* to 22*d*, and for these to be blocked by one or more actuators 17 or to be released upon activation; moreover, the C piece can also be disposed on the first coupling member 7, and the T piece can be disposed on the second coupling member 8, or vice versa.

The chamfers a on the limbs 22*a* to 22*d* of the coupling members 7, 8 shown in FIGS. 5*a* to 5*c* are used for opening the closure 9 without impairment and are adapted to the geometric requirements and can also be eliminated in an appropriate design, for example with sufficient play.

Figure 6:
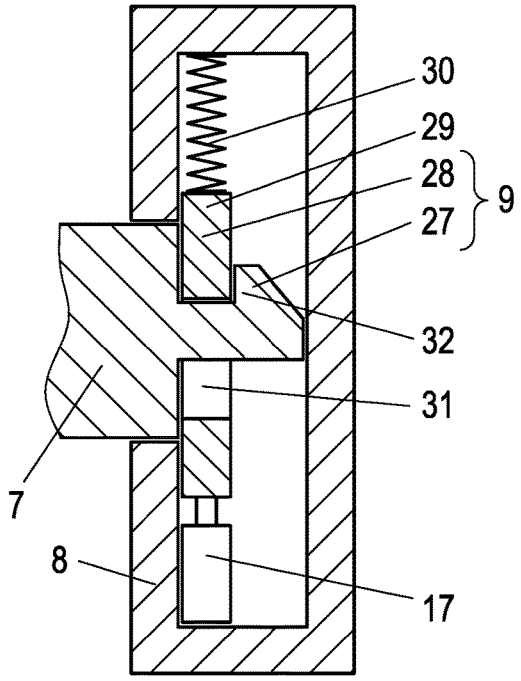
FIGS. 6 and 7 show variants of coupling members of the belt stanchion of FIG. 1 having mutually engageable hook and detent elements, which can be displaced (FIG. 6) or rotated (FIGS. 7*a* and 7*b*) with respect to each other, in each case in a sectional view (FIG. 7*b* along the intersecting line A-A of FIG. 7*a*)

In the exemplary embodiments of FIGS. 6 and 7, the coupling members 7, 8 or the closure 9 are formed by a hook element 27 and a detent element 28 cooperating therewith, wherein the hook element 27 can be engaged on the detent element 28 and at least one of the parts that are the hook element 27 and the detent element 28 can be disengaged by the actuator 17. In the example of FIG. 6, the detent element 28 is a slide 29, which can be moved transversely to the retracting force of the belt 5 and is held in the engaged position shown in FIG. 6 by a spring element 30. On the one hand, the slide 29 is pushed out of this position by a projection 32 formed on the hook element 27 when the hook element 27 is inserted into a through-passage 31 of the slide 29, wherein the hook element 27 latchingly engages on the slide 29 behind the through-passage 31 after the insertion. On the other hand, the slide 29 is pushed out of the latchingly engaged position thereof against the spring element 30 by the actuator so as to unlatch (disengage) the closure 9 and thereby releases the hook element 27; the first coupling member 7 is again pulled out of the closure 9 as a result of the force of the retracting device 4.

It goes without saying that, as an alternative thereto, the hook element 27 can be movable alone or also additionally; moreover, both parts, these being the hook element 27 and the detent element 28, can be shaped differently or movable in another manner, as the following further exemplary variant demonstrates.

Figure 7A:
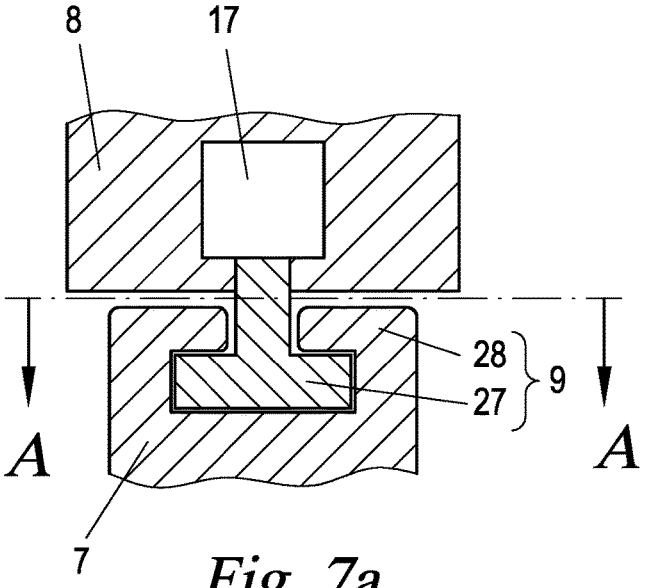
Figure 7B:
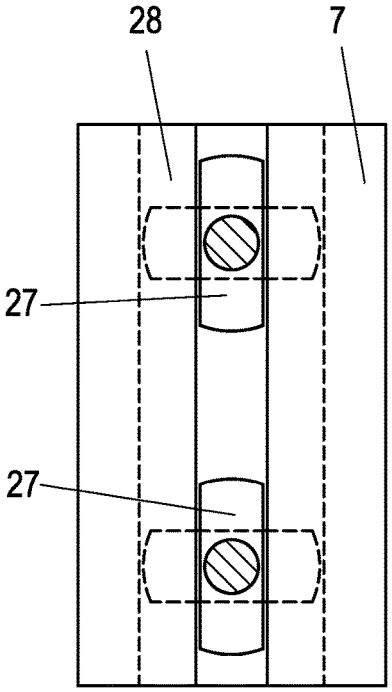

According to the example of FIGS. 7*a* and 7*b*, for example, the hook element 27 and the detent element 28 could be rotatable instead of displaceable with respect to each other. In this case, the detent element 28 is a C piece on the first coupling member 7, and the hook element 27 is a T piece on the second coupling member 8. The actuator 17 is an electromagnetic rotary drive here, optionally comprising a gearbox; however, it could also be implemented as a latchingly engageable torsion spring drive or the like. To this end, on the one hand, the second coupling member 8 can be already rotated into the engaged position and inserted into the first coupling member 7 transversely to the retracting force of the belt 5, similarly to the exemplary embodiment of FIG. 4, or, on the other hand, it can be inserted into the groove of the C piece counter to the retracting force of the belt 5 with the T piece rotated by 90 degrees and thus be latchingly engaged; or the limbs of the C piece and/or of the T piece initially pivot back on their own during engagement, similarly to the example of FIG. 6, and then engage when acted on by a spring (not shown). For unlatching or disengagement, the hook element 27 is rotated here approximately 90 degrees by the actuator 17, whereby the detent element 28 is pulled out of the hook element 27 by the retracting force of the belt 5.

In the exemplary embodiment according to FIG. 7*b*, two parallel, identically acting hook elements 27 are provided so as to prevent a rotation of the coupling members 7, 8 with respect to each other during the rotation of a hook element 27; as an alternative, one of the two hook elements 27 could be replaced by a guide pin, for example, or a housing guide, for example according to FIG. 6.

In the examples of FIGS. 6 and 7, the hook element 27 and the detent element 28 can in each case be formed both on the first and on the second coupling member 7, 8.

Figure 8A:
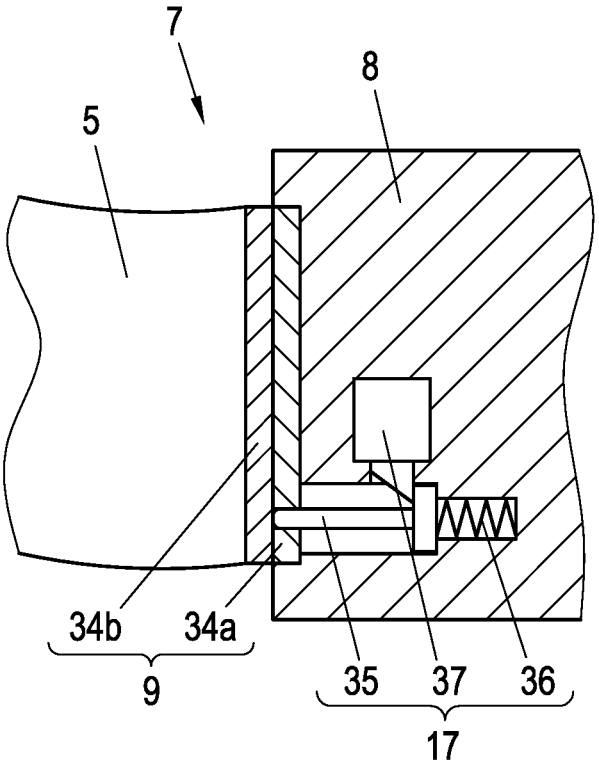
FIGS. 8 to 10 show sectional views of different variants of coupling members of the belt stanchion of FIG. 1 comprising magnetic closures, which can be opened either by a pin, shown in the closed (FIG. 8*a*) or in the opening state (FIG. 8*b*), or by a movable magnetic element (FIG. 9) or a solenoid (FIG. 10).
Figure 8B:
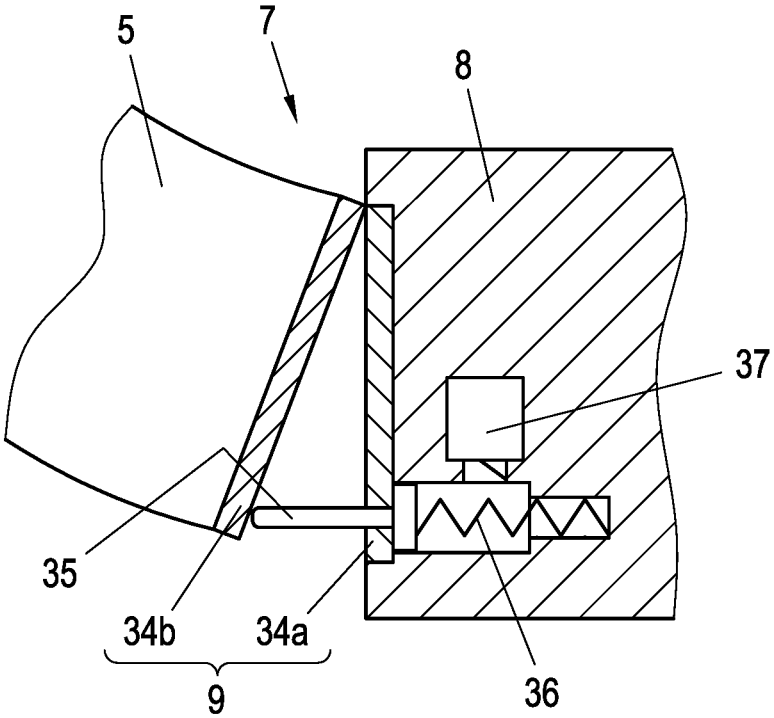
Figure 9:
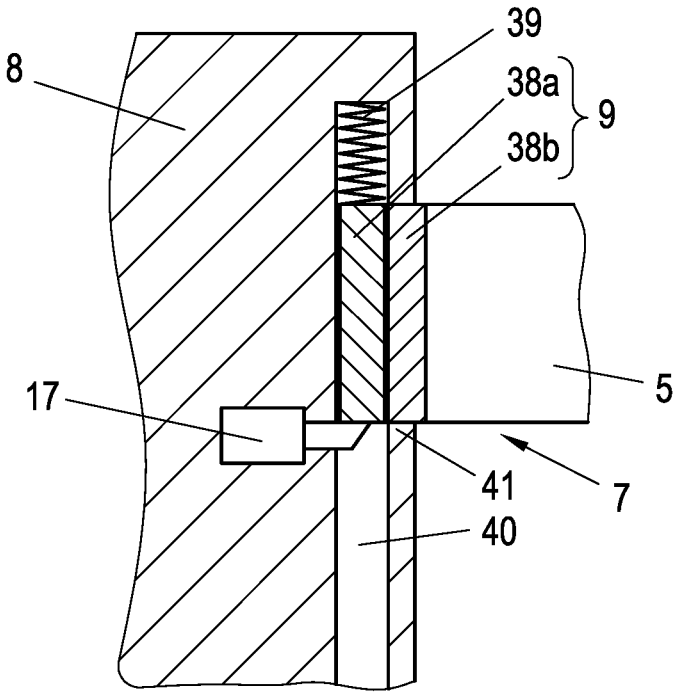
Figure 10:
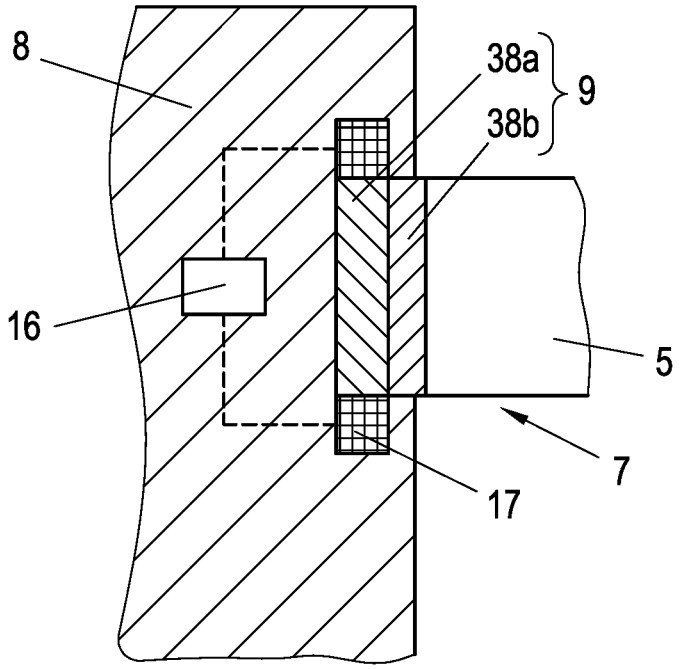

As an alternative to the mechanical closures shown in FIGS. 4 to 7, according to FIGS. 8 to 10 the closure 9 can also be designed as a magnetic closure by providing the coupling members 7, 8 with two contact surfaces 34*a*, 34*b* that magnetically adhere to each other, for example. The actuator 17 opens the closure 9 upon activation by spacing the contact surfaces 34*a*, 34*b* from each other; when suitably matched, a small distance of the contact surfaces 34*a*, 34*b* suffices to overcome the magnetic closing force, whereupon the first coupling member 7 is completely separated from the second coupling member 8 as a result of the force of the retracting device 4 acting on the belt 5.

In the example of FIGS. 8*a* and 8*b*, the actuator 17 comprises a pin 35 for this purpose, which can be extended out of the contact surface 34*a* of the second coupling member 8, for example, and which engages on the contact surface 34*b* of the first coupling member 7 and, upon activation of the actuator 17, spaces the two contact surfaces 34*a*, 34*b* from each other, or in the present example tilts them away from each other. During the closing of the closure 9, the pin 35 is initially recessed into the contact surface 34*a* counter to the force of a preloading spring 36 and thus preloads the spring 36 at the same time; in the loaded position, the pin 35 then engages with an electrically actuated trigger 37 of the actuator 17. The preloading spring 36, in turn, forms an additional mechanical energy store for the actuator 17.

As an alternative, the pin 35 could be designed so as to be electrically extendible, for example as an electromagnetically driven threaded spindle or as a rotor of a linear motor (not shown). The entire opener 15 can also be disposed in the first coupling member 7. Moreover, the two contact surfaces 34*a*, 34*b* can be permanently magnetic, or one can be permanently magnetic and the other magnetizable.

In the examples of FIGS. 9 and 10, two magnetic elements 38*a*, 38*b*, of which one is permanently magnetic and the other is magnetizable or permanently magnetic, together again form the closure 9. In the variant of FIG. 9, one of the elements 38*a*, 38*b*, which here is element 38*a*, is movably mounted in the coupling member 8 thereof and movable by the actuator 17 so as to open the closure. The actuator 17 can be a spindle drive for this purpose, the spindle of which is connected to the movable element 38*a* (not shown), or the element 38*a* is preloaded by way of a preloading spring 39 and is blocked in a holding position according to FIG. 9 by the actuator.

So as to open the closure 9, the actuator 17 releases the element 38*a*, so that the same moves away from the other element 38*b* under the action of the spring, for example tilts away or is offset approximately normal to the magnetic force in an inner guide 40 according to the example shown in FIG. 9, whereby the other element 38*b* is again lifted off as a result of the force of the retracting device 4. To prevent the element 38*b* to be lifted off from following the movement of the other element 38*a*, it is retained on a step 41 or by a guide pin (not shown), for example.

According to the example of FIG. 10, the actuator 17 is a solenoid, which upon activation by the receiver 16 generates a magnetic field that weakens the magnetic field of the permanently magnetic element 38*a*, 38*b*, whereby, in turn, a separation of the coupling members 7, 8 is carried out as a result of the force of the retracting device 4.

In the embodiments of FIGS. 9 and 10 as well, the opener 15 can be disposed in the first coupling element 7 or in the second coupling element 8.

In all embodiments, the receiver 16 can be designed as a radio receiver and detect radio remote control signals 14, which, if desired, can be encoded, so that the receiver 16 activates the actuator 17 only upon receipt of the appropriate remote control signal 14. As an alternative, the receiver 16 could also be a photosensor or a microphone, in which cases the remote control signal 14 is a light signal, such as an infrared signal, or an acoustic signal, such as an ultrasonic signal.

The energy store 19 can be a disposable battery, or also a rechargeable battery or capacitor; it supplies the receiver 16 and, depending on the embodiment, the actuator 17; as an alternative, the actuator 17 could be supplied at least partially pneumatically, hydraulically or by a weight or a spring force.

The signal transmitter 13 can be a portable hand-held transmitter or be fixedly installed in a building and, if necessary, include multiple individual transmitters or signal amplifiers. It can furthermore be connected to a central security system, such as a central fire alarm station, and be activated automatically and/or manually, for example by security staff.

The belt stanchion is not limited to the shown embodiments, but encompasses all variants and modifications that are covered by the scope of the accompanying claims.

What is claimed is:

1. A belt stanchion for a people guidance system, comprising a belt that can be extended from the belt stanchion, counter to a force of a retracting device, and a closure having two mutually complementary coupling members, of which the first coupling member is disposed at a free end of the belt and the second coupling member is disposed on the belt stanchion, wherein at least one of the coupling members is configured with an opener for the closure, the opener comprising a receiver for detecting a remote control signal, an actuator activated by the receiver upon such detection for opening the closure, and at least one energy store supplying the receiver and the actuator.

2. The belt stanchion according to claim 1, wherein the coupling members include complementarily mutually engaging T and C pieces, wherein at least one limb of a T piece is movably mounted on the coupling member thereof and can be blocked by the actuator and released upon activation of the actuator.

3. The belt stanchion according to claim 2, wherein the hook element and the detent element can be rotated with respect to each other.

4. The belt stanchion according to claim 1, wherein one coupling member comprises a hook element, which can be engaged on a detent element of the other coupling member, wherein at least one of the hook element and the detent element can be disengaged by the actuator.

5. The belt stanchion according to claim 4, wherein the hook element and the detent element can be displaced with respect to each other.

6. The belt stanchion according to claim 1, wherein the coupling members form a magnetic closure having two contact surfaces that magnetically adhere to each other, wherein the actuator, upon activation, spaces the contact surfaces from each other.

7. The belt stanchion according to claim 6, wherein the actuator comprises a pin that can be extended out of a contact surface.

8. The belt stanchion according to claim 7, wherein the pin can be recessed into the contact surface counter to a force of a preloading spring and latchingly engages with an electrically actuatable trigger in a loaded position.

9. The belt stanchion according to claim 7, wherein the pin can be electrically extended.

10. The belt stanchion according to claim 6, wherein the actuator, upon activation, spaces the contact surfaces from each other and tilts them away from each other.

11. The belt stanchion according to claim 1, wherein the coupling members include magnetic or magnetizable elements, which together form a magnetic closure, wherein one element is movably mounted in the coupling member thereof and can be moved by the actuator upon activation.

12. The belt stanchion according to claim 1, wherein the closure is a magnetic closure having at least one permanent magnet, and the actuator is a solenoid, which generates a magnetic field that weakens a magnetic field of the permanent magnet upon activation.

13. The belt stanchion according to claim 1, wherein the retracting device is a spring-loaded belt retractor in a head of the belt stanchion.

14. The belt stanchion according to claim 1, wherein the opener is disposed in the first coupling member.

15. The belt stanchion according to claim 1, wherein the opener is disposed in the second coupling member.

16. The belt stanchion according to claim 1, wherein the receiver is a radio receiver.

17. The belt stanchion according to claim 1, wherein the energy store is a disposable battery.

18. The belt stanchion according to claim 1, wherein the coupling members include complementary mutually engaging T and C pieces, wherein at least one limb of a C piece is movably mounted on the coupling member thereof and can be blocked by the actuator and released upon activation of the actuator.

* * * * *